US005894134A

United States Patent [19]

Kissinger

[11] Patent Number: 5,894,134

[45] **Date of Patent: *Apr. 13, 1999**

[54] SHIPPING CONTAINER FOR RADIOACTIVE MATERIAL

[75] Inventor: John A. Kissinger, La Jolla, Calif.

[73] Assignee: General Atomics, San Diego, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/713,839

[22] Filed: Sep. 13, 1996

[51] Int. Cl.[6] ..... G21F 5/00

[52] U.S. Cl. ..... 250/506.1; 376/272

[58] Field of Search ..... 250/506.1, 507.1; 376/272

[56] References Cited

U.S. PATENT DOCUMENTS

| | | | |
|---|---|---|---|
| 3,731,102 | 5/1973 | Peterson | 250/506.1 |
| 3,882,313 | 5/1975 | Siemens, Jr. | 250/507.1 |
| 3,886,368 | 5/1975 | Rollins et al. | 250/507.1 |
| 3,962,587 | 6/1976 | Dufrane et al. | 250/506.1 |
| 4,447,729 | 5/1984 | Doroszlai et al. | 250/506.1 |
| 4,666,659 | 5/1987 | Lusk et al. | 250/507.1 |
| 4,724,677 | 2/1988 | Foster | 62/55.5 |
| 4,827,139 | 5/1989 | Wells et al. | 250/507.1 |
| 5,025,632 | 6/1991 | Spritzer | 62/64 |
| 5,373,540 | 12/1994 | DeCooman, Sr. et al. | 376/272 |

OTHER PUBLICATIONS

Copies of Drawings Presented to U.S. Department of Energy, Idaho Field Office in Sep. 1995 by General Atomics, the Assignee of the present invention. Drawings presented pursuant to Contract No. DE–AC01 881D1 2698.

Copies of Documents sent by General Atomics, the Assignee of the present invention, to the United States Nuclear Regulatory Commission, Cask Certification Section, on Aug. 31, 1994.

*Primary Examiner*—Kiet T. Nguyen

*Attorney, Agent, or Firm*—Nydegger & Associates

[57] ABSTRACT

A container which is particularly useful for shipping fuel assemblies is provided herein. The portable container includes a first end, enclosed second end and a tubular wall which cooperates with the first end and the second to define a selectively sealed inner chamber for receiving the fuel assemblies containing the radioactive material. The tubular wall includes a tubular, substantially sealed liquid section which substantially encircles the inner chamber. A divider separates the liquid section into a main reservoir and an auxiliary reservoir which are substantially side by side. A transfer passage is provided through the divider near a lower portion of the liquid section. The transfer passage connects the main reservoir in fluid communication with the auxiliary reservoir and allows for the transfer of liquid between the main reservoir and the auxiliary reservoir to maintain the main reservoir substantially full of liquid. The container detailed herein is designed to be within the guidelines established by the Nuclear Regulatory Commission and, when loaded with radioactive spent fuel and carried by a tractor-trailer, to be within the legal truck shipping weight.

20 Claims, 8 Drawing Sheets

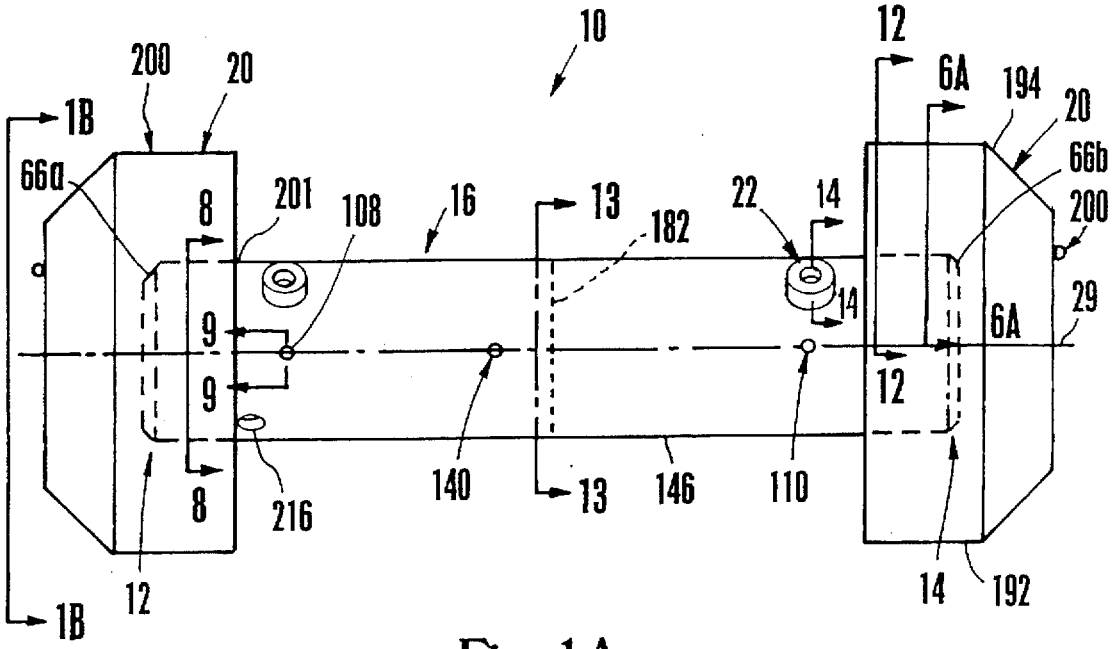
Fig. 1A
Fig. 1B
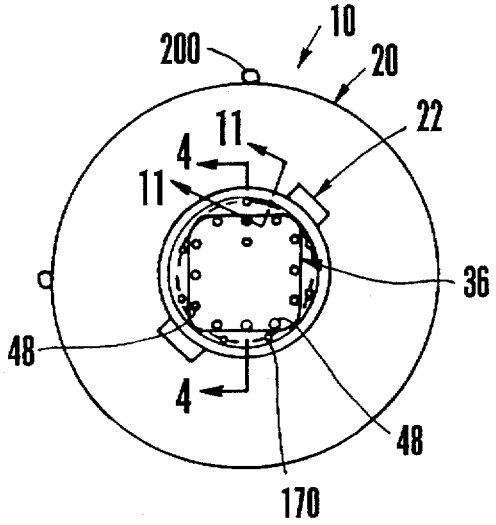

Fig. 6
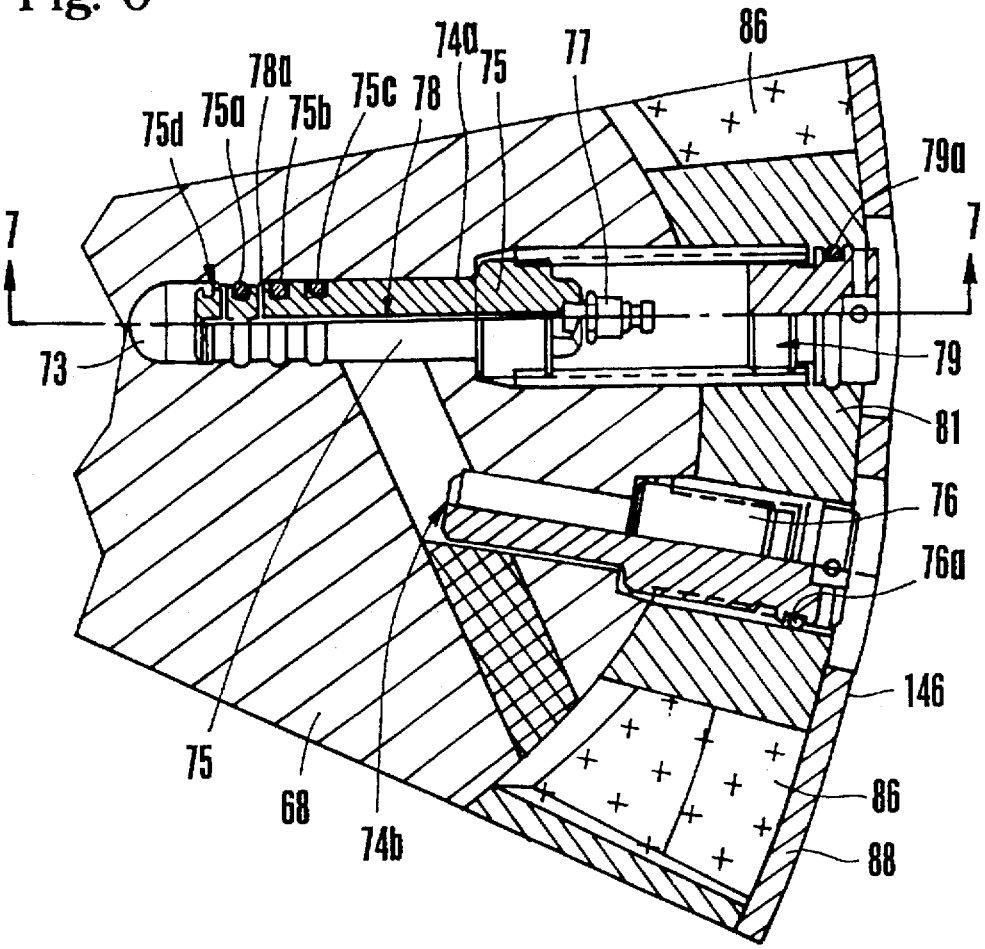
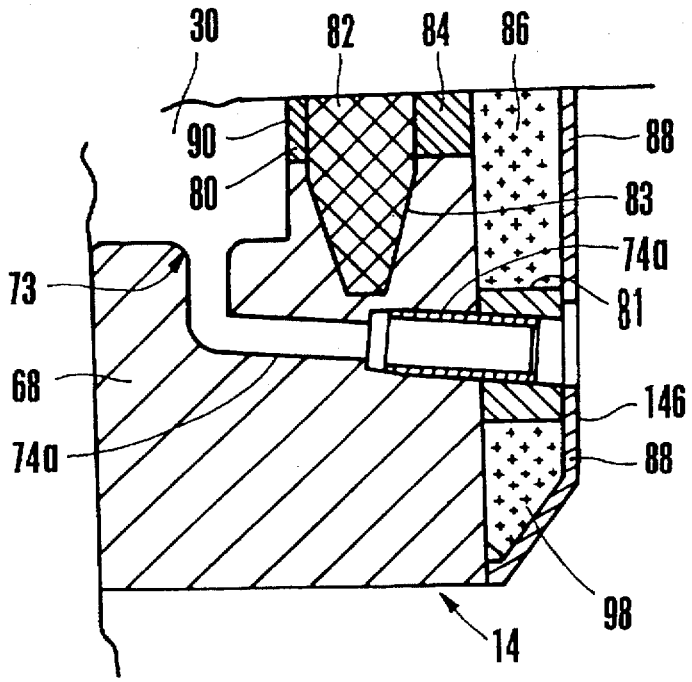
Fig. 7

SHIPPING CONTAINER FOR RADIOACTIVE MATERIAL

FIELD OF THE INVENTION

The present invention relates to a wall for shielding radioactive material which is part of a container. More particularly, the present invention relates to a shipping and storage container for radioactive material. The present invention is particularly, but not exclusively useful as a shipping container for fuel assemblies that is within the legal weight for shipping with a truck and trailer.

BACKGROUND OF THE INVENTION

Nuclear reactors are commonly used to produce electricity throughout various parts of the world. These nuclear reactors initiate and maintain a controlled nuclear chain reaction in a fissile fuel for the production of energy. The fissile fuel is commonly contained in bundles of tubes, referred to as a fuel assembly, for use in the nuclear reactor.

A pressurized water reactor ("PWR") typically utilizes a fuel assembly (hereinafter "PWR Assembly") which is approximately 8½" square and 164" long. A boiling water reactor ("BWR") typically utilizes a fuel assembly (hereinafter "BWR Assembly") which is approximately 5½" square by 176" long.

During the nuclear chain reaction, daughter particles originate in the fissile fuel as the fissile fuel disintegrates. Over time, the fissile fuel contains too many daughter particles to be efficiently used in the nuclear reactor. When this occurs, it is necessary to replace the fuel assembly containing the spent fuel.

Upon removal from the reactor, the spent fuel in the fuel assembly is very hot and very radioactive. Exposure to excessive radiation can present serious problems to humans and animals. Accordingly, it is necessary to store the spent fuel, without releasing excessive radiation, until the temperature and the level of radioactivity diminish to a sufficiently low level.

The spent fuel is stored at the nuclear plant in large cooling pools while waiting for the radioactivity of the spent fuel to decay to a safe level. As a result thereof, the cooling pools are beginning to become filled with the spent fuel at some plants.

Accordingly, there is a need to safely transport the spent fuel between plants with full cooling pools to those with available space. Further, plans are being developed for a nuclear waste site for storing the spent fuel. Thus, there will be a need in the future to safely transport the spent fuel to the waste site.

In many cases, the spent fuel must be transported with a truck and trailer since trains are not accessible to all nuclear plants. However, some states may attempt to block the transport of spent fuel on trailers on their highways. Nevertheless, under United States law, a particular state can not block passage of a truck and trailer which weighs under 80,000 pounds ("the legal truck shipping weight").

Presently, containers are available for shipping the spent fuel after the spent fuel has spent approximately ten years in the cooling pool. The Nuclear Regulatory Commission has provided strict guidelines for containers for transporting radioactive material. These containers must be able to withstand high and low temperatures, bumping, jarring and accidents which can occur during transport of the radioactive material, without allowing for the escape of predetermined levels of radioactive emissions or other contaminants.

However, many of the existing containers are too heavy for the legal truck shipping weight, are relatively expensive to manufacture, relatively expensive to maintain, and/or utilize complex piping.

Furthermore, some of these containers can only transport a relatively small amount of radioactive material in each shipment. The ability to transport more radioactive material per shipment is very significant since loading and shipping of the radioactive waste is very expensive due to the numerous precautions which must be taken during loading and shipping.

In light of the above, it is an object of the present invention to provide a container for radioactive material which can transport a substantial amount of radioactive material and still weigh less than the legal truck shipping weight. It is another object of the present invention to provide a container that can accommodate four PWR Assemblies or nine BWR Assemblies and be within the guidelines for radioactive emissions. Yet another object of the present invention is to provide a container which is not adversely affected by temperature fluctuations, minor accidents or jarring and is relatively inexpensive to manufacture and maintain. Another object of the present invention is to provide a container that is within the guidelines established by the Nuclear Regulatory Commission.

SUMMARY

The present invention is directed to a wall, which satisfies these objectives. The wall inhibits the flow of neutrons and includes an inner section having an interior surface that is to be exposed to radioactive material, an outer section, a liquid section, a divider and a transfer passage. The liquid section utilizes readily available materials and is relatively inexpensive to manufacture and maintain.

The liquid section is disposed between the inner section and the outer section. The divider separates the liquid section into a main reservoir and an auxiliary reservoir which are substantially side-by-side and axially in-line. The main reservoir is to be substantially filled with a liquid which inhibits the flow of neutrons.

The transfer passage provides the necessary limited fluid communication between the reservoirs. The transfer passage allows for the transfer of liquid between the main reservoir and the auxiliary reservoir to continually maintain the main reservoir substantially full of liquid. The transfer passage is located near a lower portion of the liquid section and opens into the main reservoir and the auxiliary reservoir near the lower portion. Preferably, the transfer passage extends through the divider to minimize the number of components of the wall.

The wall is typically tubular and part of a portable container for storing and transporting fuel assemblies. As detailed herein, the container also includes a first end, and an opposed, enclosed second end which cooperates with the tubular wall to define a substantially sealed inner chamber that is sized to receive the radioactive material. Preferably, the inner chamber is sized and shaped to receive four PWR Assemblies or nine BWR Assemblies.

Preferably, the tubular wall includes a number of sections which inhibit the flow of neutrons and gamma radiation therethrough. For example, the tubular wall can include: (i) an inner section which is tubular and metallic; (ii) a tubular, gamma section which substantially encircles the inner section; (iii) a tubular, metallic intermediate section which substantially encircles the gamma section; (iv) a substantially sealed liquid section that is tubular and substantially encircles the intermediate section; and (v) an outer section that is tubular and substantially encircles the liquid section.

Optimally, the container includes a pair of impact limiters protecting the container in the event of an accident. One of the impact limiters is disposed proximate the first end and the other impact limiter is disposed proximate the second end of the container.

Preferably, the overall weight of the container is less than about 49,000 pounds so that the container can be shipper with approximately 6,600 pounds of radioactive material such that, when combined with a truck and trailer, total weight is less than 80,000 pounds.

It is important to recognize that a container in accordance with the present invention can hold a significant amount of radioactive material and still weigh less than the legal truck shipping weight. Further, the container can fit four PWR Assemblies or nine BWR Assemblies and be within the guidelines for radioactive emissions. Further, the container is within guidelines established by the Nuclear Regulatory Commission and is not adversely affected by temperature fluctuations, minor accidents or jarring and is relatively inexpensive to manufacture, use and maintain.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which:

FIG. 1A is a side plan view of a container having features of the present invention the container is shown rotated approximately 45° from its orientation during transport;

FIG. 1B is a view taken on line 1B of FIG. 1A, this view does not include one of the impact limiters for clarity;

FIG. 6 is a cutaway view taken on line 6 in FIG. 1A, this view does not include an impact limiter for clarity;

FIG. 7 is a cutaway view taken on line 7 in FIG. 6, this view does not include a main drain plug for clarity;

DESCRIPTION

Figure 2:
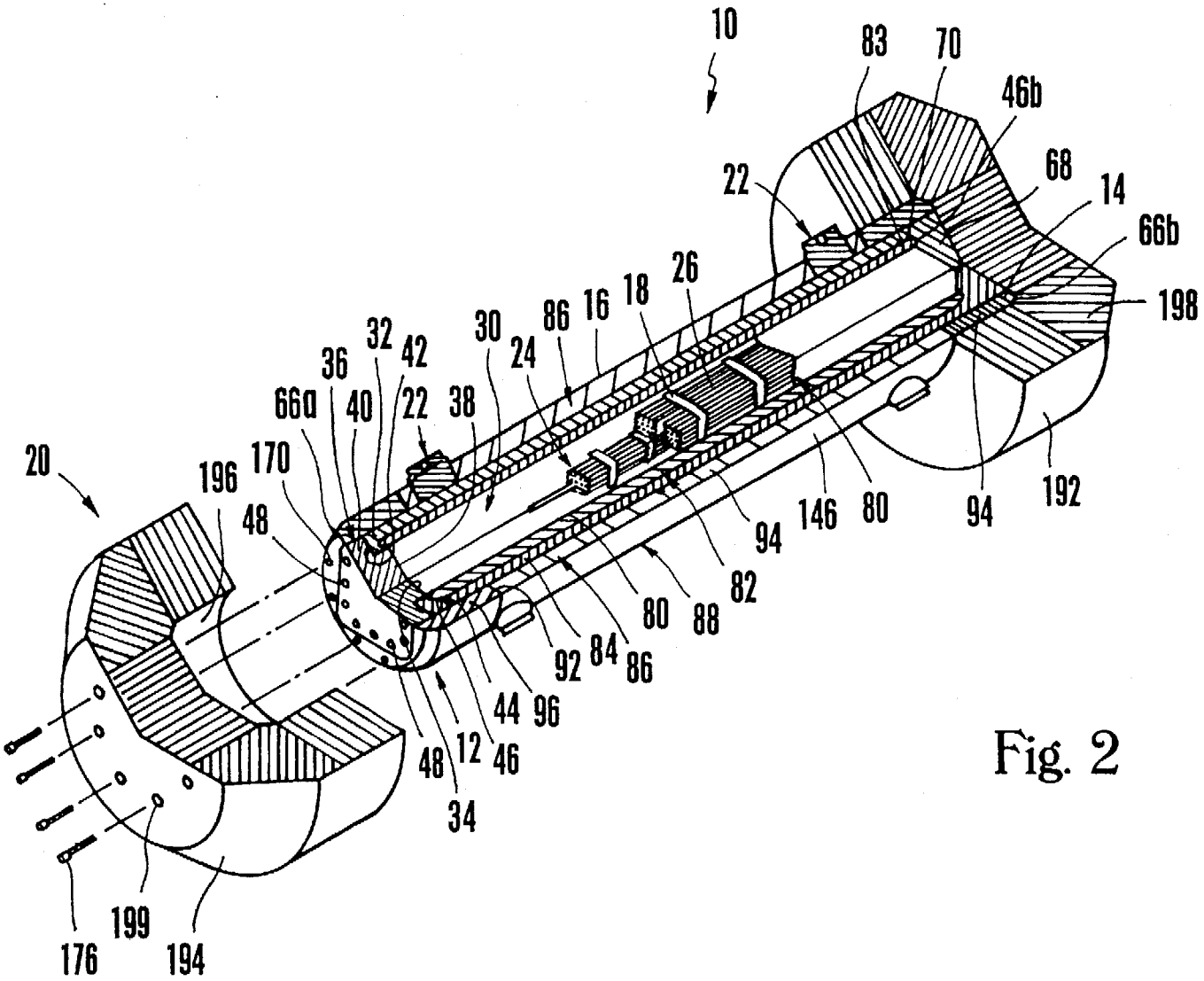
FIG. 2 is a perspective, cutaway and partial exploded view of a container suitable for enclosing four PWR assemblies.
Figure 3:
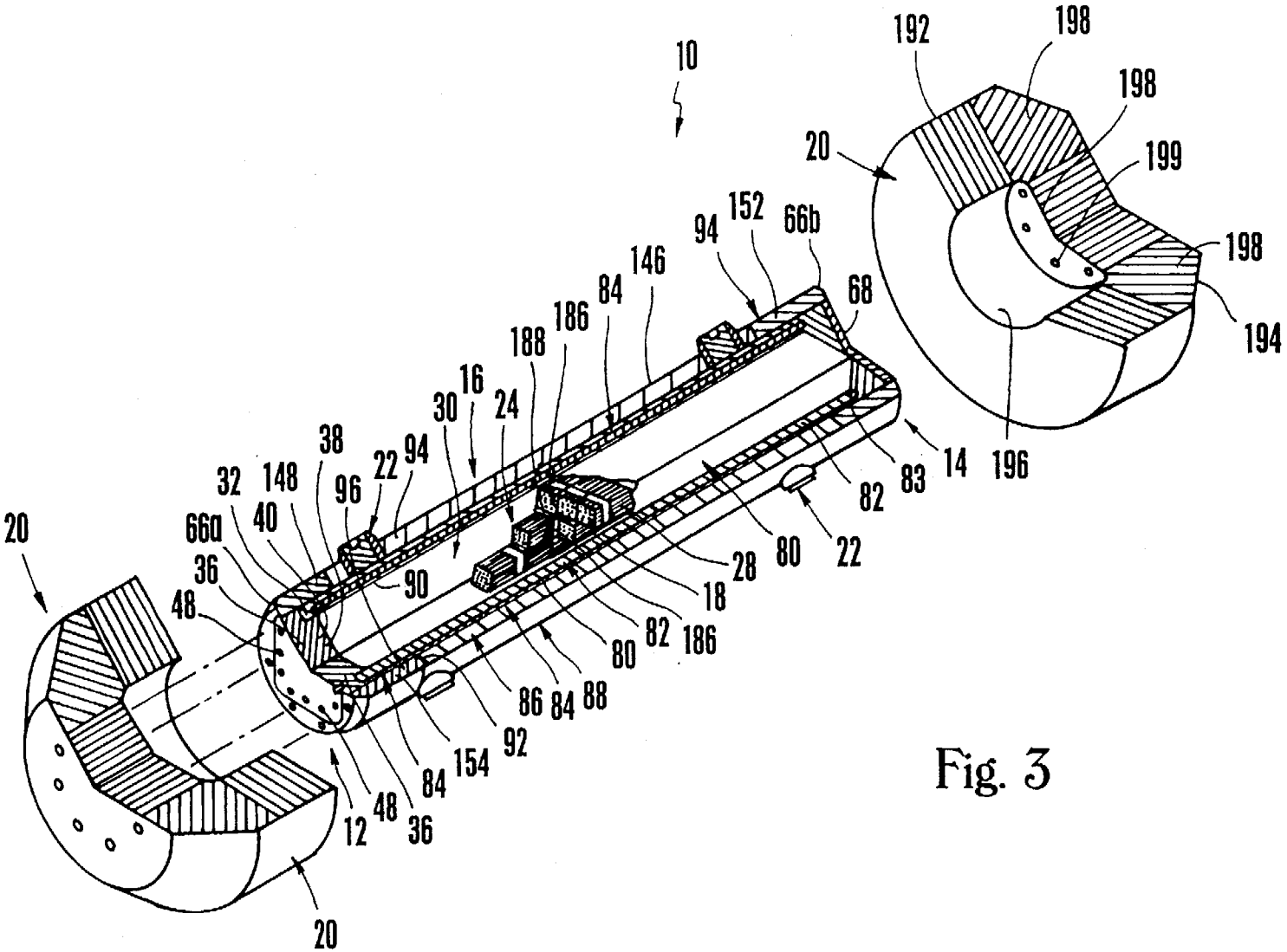
FIG. 3 is a perspective view, cutaway and partial exploded view of a container suitable for enclosing nine BWR assemblies.

Referring initially to FIGS. 1–3, a container 10 according to the present invention includes a first end 12, an opposed second end 14, a tubular wall 16, a rack 18, a pair of impact limiters 20 and mounts 22. The container 10 is particularly useful for transporting radioactive material 24. Some features of the container 10 described herein, were disclosed in documents that were presented to the U.S. Department of Energy, Idaho Field Office, in September, 1995 by the General Atomics, the assignee of the present invention, the contents of which are incorporated herein by reference. These documents were presented pursuant to contract DE-AC01-88ID12698.

The container 10 described herein is sized and shaped for shipping four PWR Assemblies 26 (FIG. 2), with a truck and trailer (not shown), while being within Nuclear Regulatory Commission guidelines and being within the legal truck shipping weight. The overall weight of the container 10 including the mounts 22 and impact limiters 20, described herein is less than about 49,000 pounds.

However, the present invention is also useful for transporting nine BWR Assemblies 28 (FIG. 3) or other radioactive material 24, or waste suitable for transport by a truck and trailer. Further, the container 10 may be useful for transporting any of the above mentioned radioactive materials 24 with another mode of transportation such as a train (not shown) or an airplane (not shown). Additionally, the container 10 may be useful for storing radioactive material 24 at an approved nuclear waste site (not shown).

Accordingly, the shape and size of the container 10 varies according to the radioactive material 24, the mode of transportation and the intended use for the container 10. For example, if the radioactive material 24 is transported with a train, the size and shape of the container 10 can be increased since the train can carry a heavier payload. Thus, the present invention is not specifically limited to the size and shape of the container 10 detailed herein.

The container 10 shown in the Figures includes a central axis 29. The container 10 is designed to be shipped with the central axis 29 substantially horizontal with the mounts 22 positioned in substantially the same horizontal plane.

The first end 12, the second end 14 and the tubular wall 16 cooperate to define a substantially sealed inner chamber 30 that encloses the radioactive material 24. The required shape and size of the inner chamber 30 varies according to the size and shape of the radioactive material 24. For example, an inner chamber 30 having a square cross-section which is approximately 18 inches wide and a length which is approximately 166 inches long is sufficient for holding four PWR Assemblies 26. Alternately, the inner chamber 30 will need to be approximately 178 inches long to hold nine BWR Assemblies.

Figure 4:
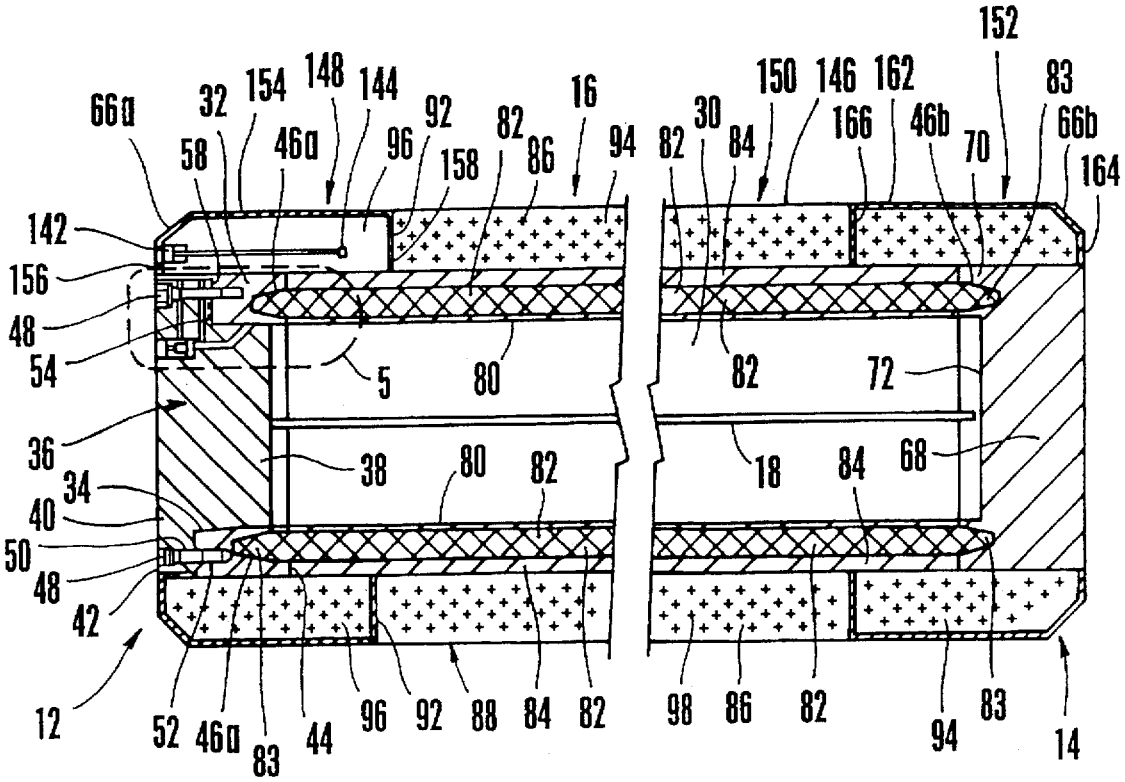
FIG. 4 is a cutaway view taken on line 4, FIG. 1A, this view does not include the impact limiters.
Figure 5:
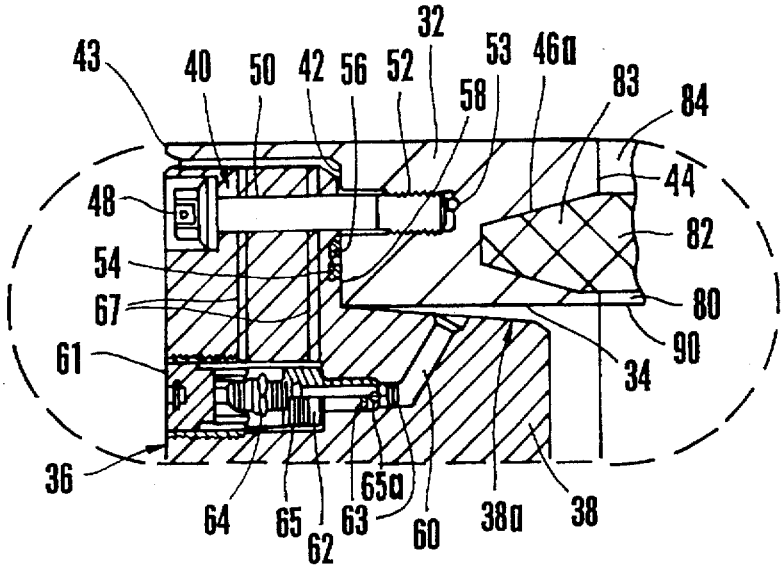
FIG. 5 is cutaway view taken on line 5 in FIG. 4.

Referring to FIGS. 4 and 5, the first end 12 includes a square, first ring 32 which defines a cask opening 34 which allows the radioactive material 24 to be placed between the tubular wall 16. The size and shape of the cask opening 34 varies according to the size and shape of the radioactive material 24. For example, a cask opening 34 having a square cross-section which is approximately 18 inches wide is sufficient for receiving four PWR Assemblies 26 or nine BWR Assemblies 28.

A cask closure 36 selectively closes the cask opening 34. The design of the cask closure 36 varies according to the design of the cask opening 34. For the example described above, the cask closure 36 has a substantially square cross-section and includes a first part 38 that is approximately 18 inches wide and a second part 40 that is approximately 26 inches wide. The first part 38 fits inside the cask opening 34 while the second part 40 fits over the cask opening 34 and a front surface 42 of the first ring 32. Preferably, sides 38*a* of the first part 38 are slightly tapered to facilitate installation of the cask closure 36.

The first ring 32 also includes a protruding lip 43 which extends away from the front surface 42 and encircles the second part 40 of the cask closure 36. A rear surface 44 of the first ring 32 includes a first gamma groove 46*a* for receiving a portion of the tubular wall 16 as detailed below.

Referring to FIGS. 2–5, a plurality of spaced apart closure bolts 48 can be used to selectively secure the cask closure 36 to the first ring 32. Each closure bolt 48 extends through a closure aperture 50 in the second part 40 of the cask closure 36 and attaches to an internally threaded, ring aperture 52 in the front surface 42 of the first ring 32. Preferably, a bolt drain passageway 53 extends into a bottom of each ring aperture 52 to allow for draining of any liquid which may flow into the ring aperture 52. The bolt drain passageway 53 can also be seen in FIG. 7.

The embodiment shown in the Figures includes twelve (12) closure bolts 48 that are made of Inconel 718. Alternately, the cask closure 36 can be secured in other ways known by those skilled in the art.

A cask seal 54 is used to seal the interface between the cask opening 34 and the cask closure 36. The cask seal 54 can be implemented in a number of alternate ways. Referring again to FIGS. 4 and 5, the cask seal 54 can be a pair of "O" ring type seals disposed in a "O" ring groove 56 in a rear face 58 of the second part 40 of the cask closure. The "O" ring type seals contact the front surface 42 of the first ring 32 to seal the interface. A cask seal passageway (not shown) can be added to the cask closure 36 which facilitates testing of the cask seal 54 for leaks.

Referring to FIG. 5, the first end 12 includes a cask vent 60 and a vent plug 62 for draining the inner chamber 30 and resealing the inner chamber 30. In the embodiment shown in the figures, the cask vent 60 extends through the cask closure 36 into the inner chamber 30. The cask vent 60 includes an internally threaded surface which mates with a corresponding externally threaded surface on the vent plug 62. Preferably, the vent plug 62 includes a pair of plug seals 63 for sealing the cask vent 60. Further, the vent plug 62 can include a vent quick connect coupling 64 that is in fluid communication with a plug seal passageway 65 having an opening 65*a* between the pair of plug seals 63 to facilitate testing of the plug seals 63.

Preferably, the cask vent 60 includes a pair of vent passageways 67 which allow liquid to drain from the cask vent 60. Further, a vent cover 61 can be threaded into the cask vent 60 to protect the vent plug 62.

The second end 14 includes an enclosure plate 68 having a square cross-section which encloses the inner chamber 30 at the second end 14. Referring to FIG. 4, the enclosure plate 68 is approximately 9.5 inches thick. A square, tube-shaped, enclosure projection 70 extends outwardly from a front surface 72 of the enclosure plate 68 near the outer perimeter. The enclosure projection 70 includes a second gamma groove 46*b* for receiving a portion of the tubular wall 16.

The second end 14 includes a cask drain 73 for draining the inner chamber 30. The cask drain 73 can be implemented in a number of alternate ways. For example, referring to FIGS. 6 and 7, the cask drain 73 can extend into the inner chamber 30 and branch into two drain passageways 74*a*, 74*b*. Each drain passageway 74*a*, 74*b* includes an internally threaded surface which corresponds to an externally threaded surface on a main drain plug 75 and a flow drain plug 76. The main drain plug 75 is threaded into one of the drain passageways 74*a* to seal the cask drain 73 while the flow drain plug 76 is threaded into the other drain passageway 74*b*. The main drain plug 75 includes three drain seals 75*a*, 75*b*, 75*c* for sealing the cask drain 73 and a guide 75*d* for protecting the drain seals 75*a*, 75*b*, 75*c*. Further, the main drain plug 75 can include a drain quick connect coupling 77 that is in fluid communication with a drain seal passageway 78 having an opening 78*a* between the first two drain seals 75*a*,75*b* to facilitate testing of the first drain seal 75*a*.

Preferably, a drain cover 79 can be threaded into the drain passageway 74*a* to protect the main drain plug 75. Preferably, the drain cover 79 includes a cover seal 79*a* and the flow drain plug 76 includes a flow seal 76*a* to prevent any unwanted flow of liquid. As shown in FIG. 6, a support block 81 can be disposed around the enclosure plate 68 to support the drain passageways 74*a* and 74*b*.

Again, referring to FIGS. 2, 3 and 4, the tubular wall 16 defines the sides of the inner chamber 30 and includes many sections which inhibit the emissions of radiation. These sections include a tubular inner section 80, a tubular gamma section 82, a tubular intermediate section 84, a tubular liquid section 86 and a tubular outer section 88.

The inner section 80 has an interior surface 90 which cooperates with the first end 12 and the second end 14 to define the inner chamber 30. Thus, the inner section 80 defines the size and shape of the inner chamber 30. For the embodiment shown in the Figures, the inner section 80 is square, tube shaped and has an inner width of about eighteen (18) inches and a thickness of about three-eighths (⅜) of an inch.

The gamma section 82 substantially encircles the inner section 80 and is primarily used to block or shield gamma rays. In the embodiment shown in the Figures, the gamma section 82 is square, tube shaped and has an inner width of about 19¾ inches and a thickness of about 2.65 inches.

The gamma section 82 is made from a heavy metal which blocks or inhibits the flow of gamma rays. Depleted uranium, namely uranium with most of the U235 removed, such that the depleted mixture is approximately 99.8% of U238 and approximately 0.2% U235, makes an excellent gamma section. The gamma section 82 can a divided into a plurality of parts (not shown) which slide over the inner section 80 for ease of fabrication. Further, the gamma section 82 can also include taper ends 83 for ease of assembly with the first gamma groove 46*a* and the second gamma groove 46*b*.

The intermediate section 84 encircles the gamma section 82 and provides support to the container 10. In the embodiment shown in the figures, the intermediate section 84 is square tube shaped. The intermediate section 84 has an inner width of about 25 inches and a thickness of about 1½ inches.

In the embodiment shown in the figures, the first end 12 and the second end 14 are secured to the intermediate section 84 and the inner section 80 to hold the intermediate section 84 and inner section 80 around the gamma section 82. The intermediate section 84 and inner section 80 can be welded to the first end 12 and second end 14 or attached is some other suitable fashion known by those skilled in the art.

The liquid section 86 substantially encircles the intermediate section 84 and is primarily used to inhibit the passage of neutrons through the wall 16. Referring to FIG. 4, the liquid section 86 is a sealed liquid cavity formed between the intermediate section 84 and the outer section 88.

A divider 92 extends between the intermediate section 84 and the outer section 88 and separates the liquid section 86 into a sealed main reservoir 94 and a sealed auxiliary reservoir 96 which are substantially side-by-side or, stated another way, substantially axially in-line.

The main reservoir 94 is filled and the auxiliary reservoir 96 is partly filled with a liquid 98 which substantially inhibits the flow of neutrons and withstands temperature fluctuations of approximately 170° F. to −20° F. For example, the liquid 98 can be a mixture of about 60% propylene glycol and 40% water. The propylene glycol inhibits freezing. Alternately, the liquid 98 can be other mixtures, depending on the desired temperature range. The main reservoir 94 is sized and located to meet regulatory radiation dose limits, while the auxiliary reservoir 96 is not required to meet these limits.

A transfer passage 100 connects the main reservoir 94 in fluid communication with the auxiliary reservoir 96. The transfer passage 100 allows for the transfer of liquid 98 between the main reservoir 94 and the auxiliary reservoir 96 to maintain the main reservoir 94 substantially full of liquid 98 as the temperature of the liquid 98 changes. So while the main reservoir 94 is always full of liquid 98, the level of liquid 98 in auxiliary reservoir 96 depends upon the temperature of the liquid 98.

Figure 8:
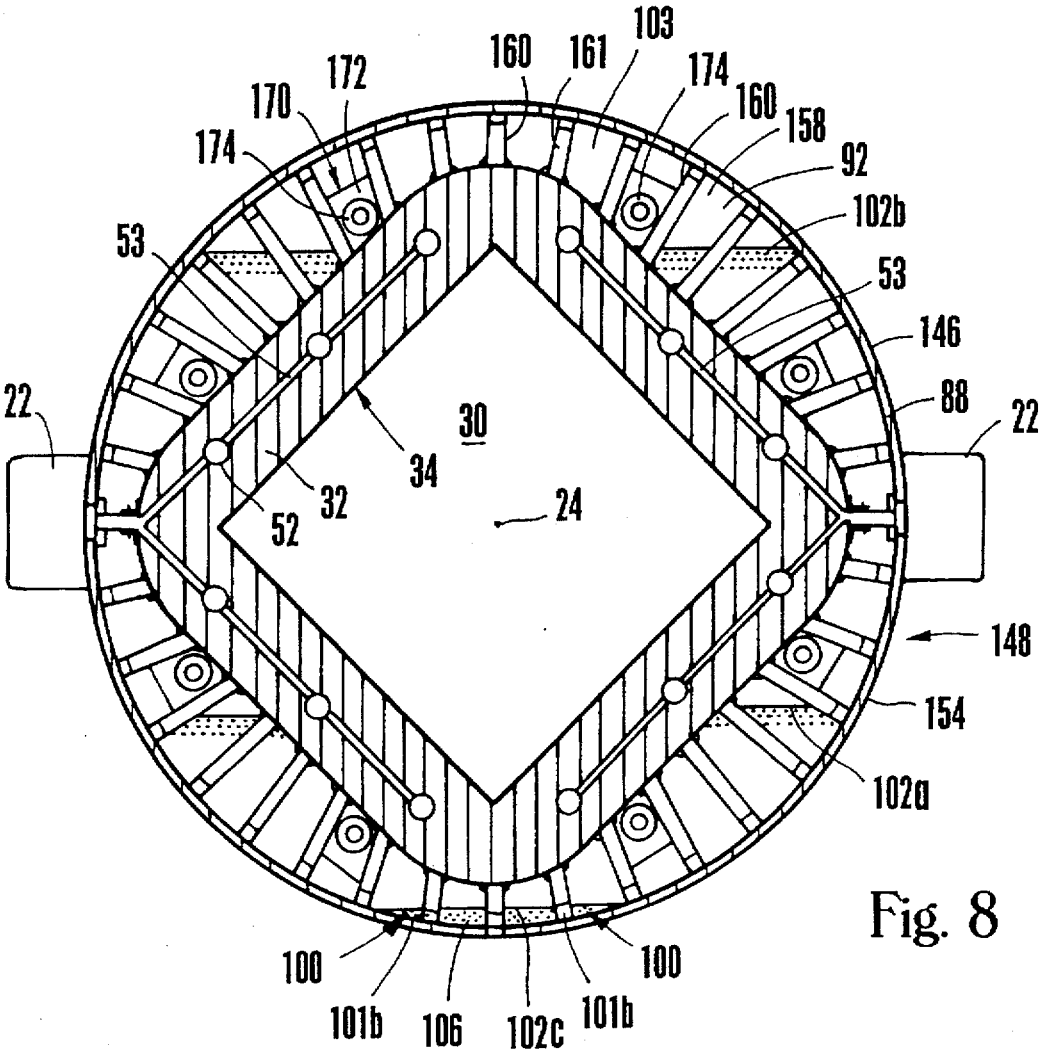
FIG. 8 is a cutaway view taken on line 8 in FIG. 1A, this view does not include a cask closure, the rack or impact limiters for clarity, this view has been rotated approximately 45° to show the orientation of the container during transport.

Referring to FIG. 8 (looking from the auxiliary reservoir 96 towards the main reservoir 94), when the liquid 98 is at approximately 70 degrees Fahrenheit, the level of liquid 98 in the auxiliary reservoir 96 is approximately at the level represented by reference number 102*a*. The pressure of the gas 103, i.e. air, above the liquid 98 in the auxiliary reservoir 96, prevents the liquid 98 from flowing from the main reservoir 94 into the auxiliary reservoir 96.

As the temperature of the liquid 98 increases, the liquid 98 expands and flows into the auxiliary reservoir 96, compressing the air and increasing the pressure in both reservoirs. The level of liquid 98 in the auxiliary reservoir 96 at approximately 170 degrees Fahrenheit is approximately at the level represented by reference number 102*b*.

Conversely, as the temperature of the liquid 98 decreases, the liquid 98 contracts. The gas 103 in the auxiliary reservoir 96 expands as it forces liquid 98 from the auxiliary reservoir 96 into the main reservoir 94. Although the gas 103 pressure changes as the liquid 98 expands and contracts, it is always high enough to maintain the main reservoir 94 substantially full of liquid 98. The level of liquid 98 in the auxiliary reservoir 96 at approximately −20 degrees Fahrenheit is approximately at the level represented by reference number 102*c*.

If for some reason, gas, or air is present in the main reservoir 94, the container 10 can be placed on its second end 14, with its central axis 29 substantially vertical, and gas in the main reservoir 94 will be displaced by liquid 98 from the auxiliary reservoir 96.

The transfer passage 100 opens into the main reservoir 94 and the auxiliary reservoir 96 proximate a lower portion 106 of the liquid section 86. Referring to FIG. 8, the lower portion 106 of the liquid section 86 is substantially the lowest part of the liquid section 86 when the container 10 is being shipped. Since the container 10 is designed to be shipped with the container 10 oriented with its central axis 29 substantially horizontal, the lower portion 106 is positioned directly below the central axis 29 of the container 10.

Figure 9:
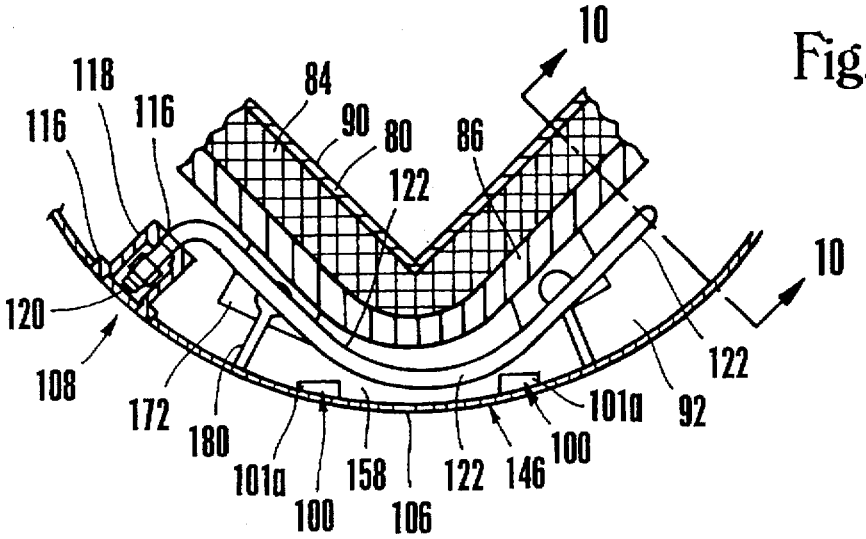
FIG. 9 is a cutaway view taken on line 9 in FIG. 1.

Referring to FIG. 9 (looking from the main reservoir 94 towards the auxiliary reservoir 96), the transfer passage 100 is a pair of apertures which extend through the divider 92 proximate the lower portion 106 of the liquid section 86. In the embodiments illustrated in the Figures, the transfer passage 100 includes a first opening 101*a* (shown in FIG. 9) which opens into the main reservoir 94 and a second opening 101*b* (shown in FIG. 8) which opens into the auxiliary reservoir 96. These apertures are located at substantially the lowest level in the divider 92 when the container 10 is oriented for shipment. In this embodiment, each of the apertures has a cross-sectional area of about 0.7 square inches.

The liquid section 86 includes a liquid overflow 108 and a liquid inlet 110 for filling the main reservoir 94 and partially filling the auxiliary reservoir 96 with the liquid 98. Basically, the liquid 98 is injected into the liquid section 84 through the liquid inlet 110 until liquid 98 flows from the liquid overflow 108 to precisely fill the liquid section 86. Once the main and auxiliary reservoirs 94 and 96 have been correctly filled and sealed at initial fabrication, the volume of liquid 98 is constant and very little periodic maintenance is required to check or adjust the liquid levels.

The liquid overflow 108 and liquid inlet 110 can be implemented in a number of alternate ways. For example, referring to FIGS. 1A, 9, 10, and 13, the liquid overflow 108 is located near the first end 12 below the impact limiter 20 and the liquid inlet 110 is located near the second end 14 above the impact limiter 20.

As can best be seen with reference to FIG. 9, the liquid overflow 108 includes an overflow base 116 secured to the outer section 88, an overflow quick connect fitting 118 secured to the overflow base 116, an overflow plug 120 for covering the quick connect fitting 118 and an overflow tube 122 which is connected to the overflow quick connect fitting 118.

Figure 10:
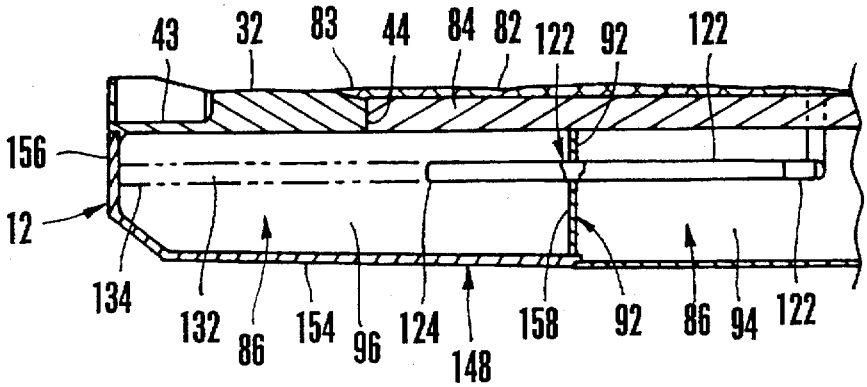
FIG. 10 is a cutaway view taken on line 10 in FIG. 9.

Referring to FIGS. 9 and 10, the overflow tube 122 is bent around the intermediate section 84 for ease of assembly and toward the first end 12 through the divider 92. The overflow tube 122 includes a distal overflow end 124 which is disposed in the auxiliary reservoir 96. Since the liquid 98 is injected into the liquid section 84 through the liquid inlet 110 until liquid 98 flows from the liquid overflow 108, the location of the distal overflow end 124 determines the amount of liquid 98 retained in the auxiliary reservoir 96. For filling the liquid section 86 at approximately 70 degrees Fahrenheit, the distal overflow end 124 is positioned about 6.7 inches above the divider 92. At this level, the auxiliary reservoir 96 contains approximately nine (9) gallons of liquid 98.

Figure 13:
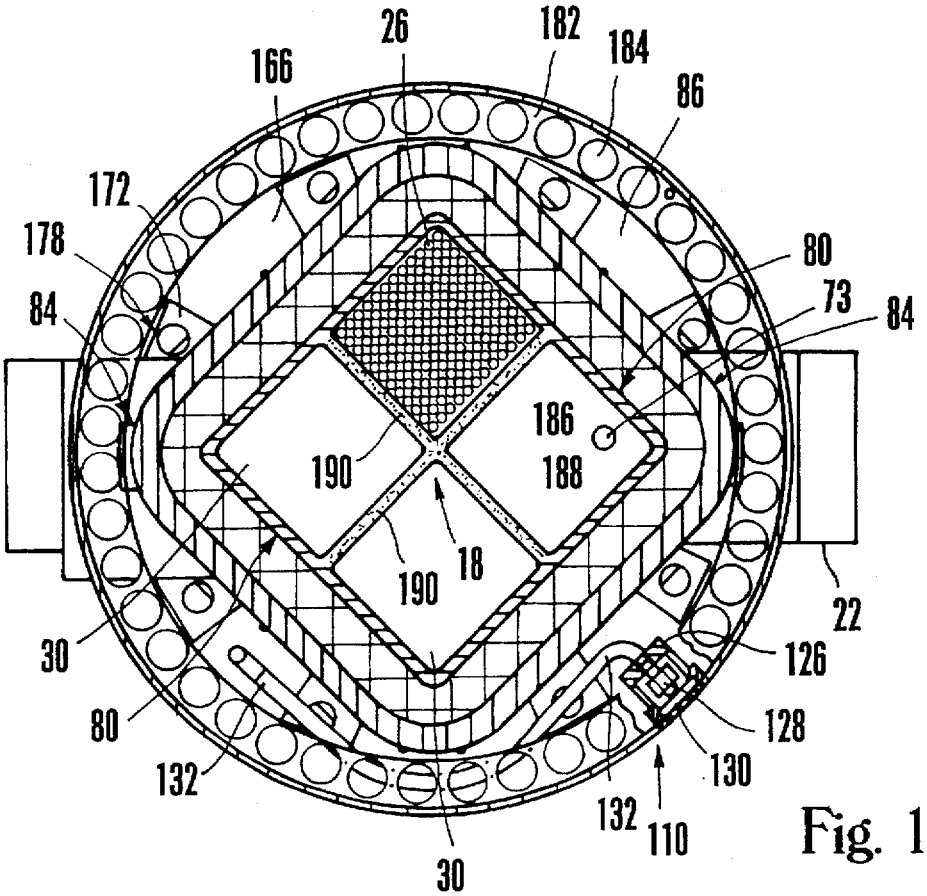
FIG. 13 is a cutaway view taken on line 13 in FIG. 1.

Referring to FIG. 13, the liquid inlet 110 includes an inlet base 126 secured to the outer section 88, an inlet quick connect fitting 128 secured to the inlet base 126, an inlet plug 130 for covering the inlet quick connect fitting 128 and an inlet tube 132 which is connected to the quick connect fitting. The inlet tube 132 is bent around the intermediate section 84 for ease of assembly and toward the second end 14. The inlet tube 132 includes a distal inlet end 134 which is located approximately ¼ of an inch away from the second end 14. For reference purposes only, the inlet tube 132 is shown in phantom in FIG. 10. However, as detailed above, the inlet tube 132 is actually directed towards the second end 14.

Preferably, the liquid section 86 also includes a relief valve 140 which releases liquid 98 from the liquid section 86 in the event the pressure inside the liquid section 86 reaches a predetermined extreme high level, i.e., 150 P.S.I. Referring to FIG. 1A, the relief valve 140 extends through the outer section 88 and is located between the first end 12 and the second end 14. A suitable relief valve 140 is sold by NUPRO, located in Willoughby, Ohio.

Further, the liquid section 86 can include a liquid level tester 142 for ensuring that the level of liquid 98 in the auxiliary reservoir 96 is at the appropriate level. The liquid level tester 142 shown in FIG. 4 utilizes a float 144 to determine if the level of liquid 98 is sufficient when the container 10 is oriented with its central axis 29 substantially vertical.

The outer section 88 substantially encircles the liquid section 86. The outer section 88 is circular, tube shaped and has an outer diameter of about 39.75 and a thickness of about 0.2. The outer section 88 has an exterior surface 146.

Referring to FIG. 4, the outer section 88 cooperates with the intermediate section 84 to form the liquid section 86. For example, the outer section 88 and the liquid section 86 can be formed from a top portion 148, a center portion 150, and a bottom portion 152.

The top portion 148 and the bottom portion 152 interact with the impact limiters 20 to provide support to the container 10 and are similar shaped structures. The top portion 148 is secured to the intermediate section 84 and the first ring 32 approximate the first end 12 and the bottom portion 152 is secured to the intermediate section 84 and the enclosure plate 68 approximate the second end 14.

The top portion 148 includes: (i) a top annular ring 154; (ii) a flat, outer top disk 156; and (iii) an opposed, flat, inner top disk 158. The top annular ring 154 defines a portion of the exterior surface 146. The outer top disk 156 extends between and connects the top annular ring 154 to the protruding lip 43 and the inner top disk 158 extends between the top annular ring 154 and the intermediate section 84. In the embodiment shown in the Figures, the top portion 148 defines the auxiliary reservoir 96 and the inner top disk 158 defines the divider 92 between the auxiliary reservoir 96 and the main reservoir 94. The transfer passage 100 is disposed in the inner top disk 158.

The top portion 148 includes a top chamfer **66*a* at the junction between the top annular ring 154 and the outer top disk 156 to facilitate attachment of one of the impact limiters 20 over the top portion 148. A plurality of top braces 160, i.e., flat plates can extend between the top annular ring 154, the outer top disk 156 and the inner top disk 158 to transfer any impact from the impact limiters 20 to the intermediate section 84. The top braces 160 can include apertures (not shown) extending therethrough to provide for additional volume for the auxiliary reservoir 96**.

Similarly, the bottom portion 152 includes: (i) a bottom annular ring 162; (ii) a flat, outer bottom disk 164; and (iii) an opposed, flat inner bottom disk 166. The bottom annular ring 162 also defines a portion of the exterior surface 146. The outer bottom disk 164 extends between and connects the bottom annular ring 162 and the enclosure plate 68 and the inner bottom disk 166 extends between the bottom annular ring 162 and the intermediate section 84 to form a portion of the liquid section 86. In the embodiment shown in the Figures, the bottom portion 152 forms a portion of the main reservoir 94. Apertures (not shown) extend through the inner bottom disk 166 to allow for free flow of the liquid 98 through the inner bottom disk 166.

The bottom portion 152 also includes a bottom chamfer **66*b* at the junction between the bottom annular ring 162 and the outer bottom disk 164 to facilitate attachment of one of the impact limiters 20 over the bottom portion 152. A plurality of bottom braces 168, i.e., flat plates can extend between the bottom annular ring 162, the outer bottom disk 164 and the inner bottom disk 166 to transfer any impact from the impact limiters 20 to the intermediate section 84**.

Figure 11:
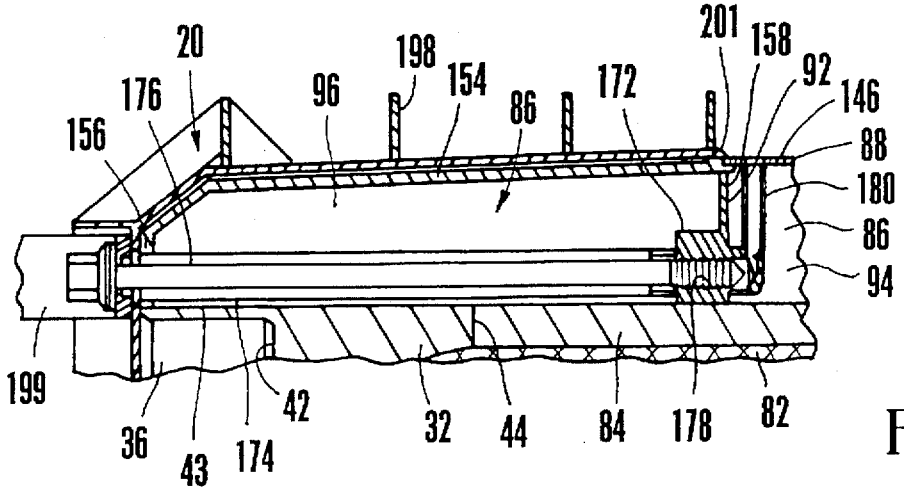
FIG. 11 is a cutaway view taken on line 11 in FIG. 1.

In the embodiment shown in the Figures, the top portion 148 and the bottom portion 152 each include a plurality of spaced apart limiter attachers 170 for attaching the impact limiters 20 to the container 10. Referring to FIG. 11, each limiter attacher 170 can include a impact block 172, an impact tube 174 and an impact bolt 176. The impact block 172 is secured to the intermediate section 84 and either the inner top disk 158 or the inner bottom disk 166. The impact block 172 includes an internally threaded surface 178 for selectively receiving the impact bolt 176. The impact tube 174 seals the impact block 172 and either the outer top disk 156 or the outer bottom disk 164. The impact attachers 170 proximate the first end 12 can include drains 180 for draining any liquid 98 from the impact tube 174 and input block 172. Each impact bolt 176 can be made of Inconel 718.

Referring to FIG. 4, the center portion 150 includes a circular ring, that extends between the inner top disk 158 and the inner bottom disk 166. The center portion 150 interconnects the top portion 148 and bottom portion 152 to complete the liquid section 86 and the outer section 88. The center portion 150 and the bottom portion 152 are in fluid communication via the apertures which extend through the inner bottom disk 166. The center portion 150 and the bottom portion 152 cooperate to form the main reservoir 94.

Referring to FIG. 13, the center portion 150 can include a flat stiffening disk 182 which extends between the intermediate section 84 and the outer section 88 for stiffening the container 10. The stiffening disk 182 is positioned between the first end 12 and the second end 14. The stiffening disk 182 includes disk apertures 184 for the transfer of the liquid 98 therethrough.

Figure 12:
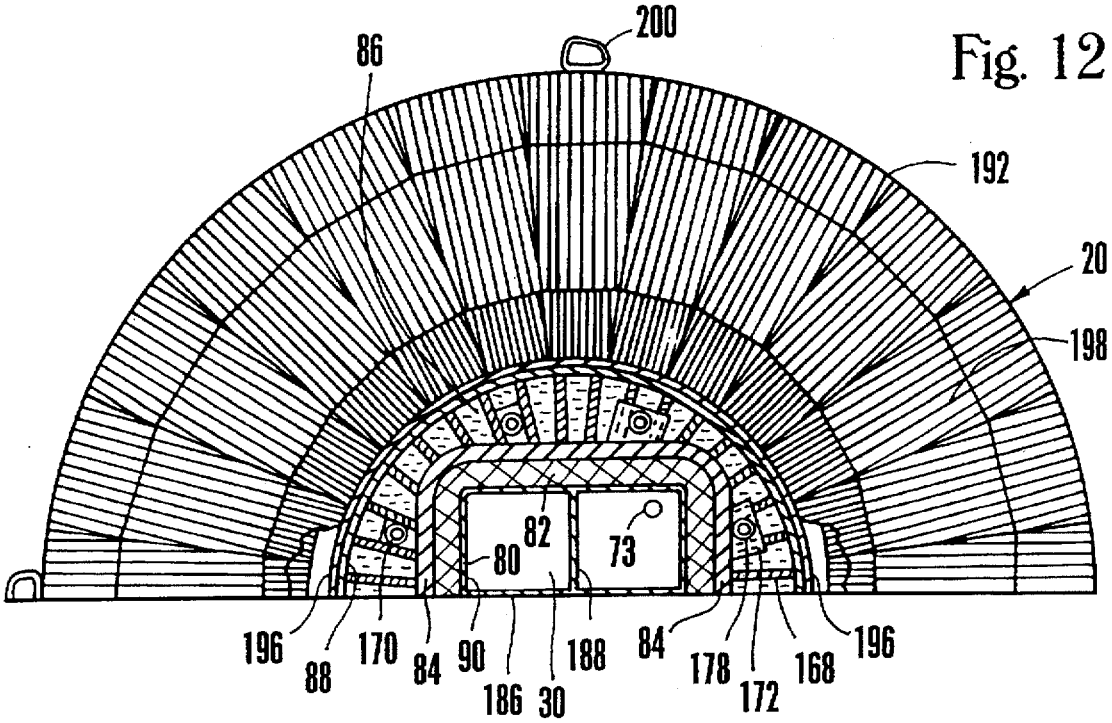
FIG. 12 is a cutaway view taken on line 12 in FIG. 1.

Preferably, the container 10 also includes the rack 18 for supporting the radioactive material 24. The shape of the rack 18 depends upon the radioactive material 24. Referring to FIGS. 12 and 13, the rack 18 can be a flat, planer, vertical wall 186 which intersects with a flat, planer, horizontal wall 188. The vertical wall 186 and the horizontal wall 188 are arranged in the form of a "plus sign". Referring to FIG. 2, this rack 18, when installed into the inner chamber 30, forms an open block of four squares for receiving four PWR Assemblies 26. Alternately, referring to FIG. 3, a plurality of vertical walls 186 can intersect a plurality of horizontal walls 188 to form an open block of nine squares for receiving nine BWR Assemblies 28.

In the embodiment shown in FIGS. 2 and 13, the vertical walls 186 and horizontal walls 188 are about 0.6 inches thick. In the Embodiment shown in FIG. 3, where the BWR Assemblies 28 to be supported are smaller and lighter in weight, the horizontal walls 188 are about 0.44 inches thick. Referring to FIG. 13, the vertical wall 186 and horizontal wall 188 can include boron passages 190 retaining B4C boron carbide pellets which inhibit any reaction between adjacent PWR fuel assemblies 26.

The rack 18 can be removable so that the either BWR Assemblies 28, PWR Assemblies 26 or other radioactive material 24 can be retained in the container 10. Alternatively, the rack 18 can be secured, i.e., by welds, to the inner chamber 30 to provide additional support to the container 10.

Spacers (not shown) can be placed in the inner chamber 30 to inhibit shorter or smaller radioactive material 24 from moving in the container 10.

The majority of components of the container 10 including for example, the cask closure 36, inner section 80, the intermediate section 84, the outer section 88, the enclosure plate 68, the first ring 32, the stiffening disk 182 and the braces 160, 168 are made of a material which provides the required strength and resists corrosion. ASME Grade XM-19 Stainless steel that is annealed at 1925–1975 F., is an excellent material for these components. The components can be secured together by welding or some other method know by those skilled in the art.

Preferably, each internally threaded surface of the container 10 includes a threaded insert (not shown) that is replaceable if damaged.

The impact limiters 20 absorb or cushion the container 10 in the event of an accident. One impact limiter 20 is disposed at the first end 12, while the other impact limiter 20 is disposed at the second end 14. Referring to FIGS. 2,3 and 12, each impact limiter 20 has a substantially, right cylindrical shaped outer shell 192. The outer shell 192 includes a tapered, outer periphery 194 and a right cylindrical container opening 196 along a central axis for receiving a portion of the container 10. Each impact limiter 20 includes a plurality of spaced apart, honeycombed aluminum walls 198 securing the outer shell 192 to the container opening 196. The thickness and spacing of the aluminum walls 198 varies throughout the impact limiter 20 with the thickest and closes together aluminum walls 198 being near the container opening 196. Alternately, each impact limiter 20 could be made of an alternate material or have an alternate shape or support structure.

A plurality of impact apertures 199 extend through each impact limiter 20 for attaching each impact limiter 20 with the limiter attachers 170. Further, the outer shell 192 of each impact limiter 20 can include a pair of spaced apart grappling hooks 200 which facilitate moving and attaching each impact limiter 20.

Preferably, referring to FIG. 1, the first end 12 can include a tamper band 201 which easily and quickly provides a visual check to notify an inspector (not shown) that the impact limiter 20 which encircles the cask opening 34 has not been removed.

The mounts 22 facilitate lifting the container 10 and securing the container 10 to the trailer, train or waste site. Typically, each mount 22 is designed to interact with a lifting yoke (not shown). The shape, size and number of mounts 22 vary according to the design and weight of the container 10.

Figure 14:
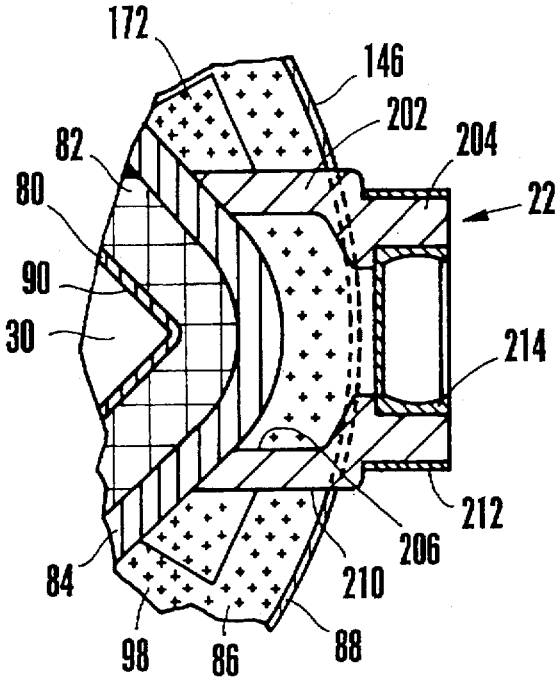
FIG. 14 is a cutaway view taken on line 14 in FIG. 1.

For example, the embodiment shown in the Figures includes four mounts 22. Referring to FIG. 14, each mount 22 is circular, ring shaped and includes an inner portion 202 which is mainly disposed in the liquid section 86 and a smaller, outer portion 204 which extends past the exterior surface 146. The inner portion 202 includes a proximal end 206 secured to the intermediate section 84 and an outer surface 210 is secured to the outer section 88. The outer portion 204 includes a replaceable outer sleeve 212 and an inner replaceable socket 214 that seals the liquid section 86. During transport of the container 10, the mounts 22 are substantially on a horizontal plane that intersects the central axis 29 of the container 10.

Referring to FIG. 1, Additionally, the container 10 can include a redundant or extra mount 216 for handling the container 10.

Filling of Liquid Section

The liquid section 86 of the container 10 is typically filled during fabrication of the container 10. During filling, the container 10 is oriented so that its central axis 29 is substantially vertical. Referring to FIGS. 9, 10 and 13, filling of the liquid section 86 is accomplished by connecting to the overflow quick connect fitting 118 to an open tube (not shown) and connecting a liquid source (not shown) to the inlet quick connect coupling 128. Subsequently, liquid 98 is added through the inlet quick connect coupling 128 at liquid inlet 110 to the main reservoir 94 and the auxiliary reservoir 96 until the liquid 98 flows from the liquid overflow 108. The overflow quick connect fitting 118 and the inlet quick connect coupling 128 are then disconnected, at which point valves within the quick disconnect fittings 118 effect a seal that contains the liquid 98.

Operation

An example of the operation of a container 10 having features of the present invention can best be visualized with initial reference to FIGS. 1–3. The operation begins with removing the impact bolts 176 and the impact limiters 20 from the container 10. Next, the container 10 is placed its second end 14 with its central axis 29 substantially vertical and the closure bolts 48 and cask closure 36 are removed to open the inner chamber 30.

For PWR assemblies 26 and BWR assemblies 28 stored in a cooling pool (not shown), the container 10 is carefully lowered into the cooling pool by the mounts 22. Next, the fuel assemblies are placed inside the inner chamber 30 while the container 10 and the fuel assemblies are in the cooling pool by a method known by those skilled in the art. Subsequently, the cask closure 36 is placed over the cask opening 34 and held in place by one or more closure bolts 48. Next, the container is removed from the cooling pool. Upon removal from the pool, the remaining closure bolts 48 are inserted into a respective internally threaded ring aperture 52.

Next, the liquid (not shown) from the cooling pool must be removed from the inner chamber 30. Referring to FIGS. 5, 6 and 7, this can be accomplished by again placing the container 10 on its second end 14 with its central axis 29 substantially vertical. Next, the flow drain plug 76 is removed and the vent plug 62 is opened and the main drain plug 75 is withdrawn to allow the liquid inside the inner chamber 30 to flow out the drain passageway **74*b*. Upon completion of draining, the main drain plug 75 and flow drain plug 76 are reinserted and an inert gas, e.g., helium, can be pumped into the inner chamber 30 prior to crossing the vent plug 62**.

Next, the exterior surface 146 is thoroughly cleaned and decontaminated and container to is attached by the mounts 22 to the trailer. Finally, the impact limiters 20 are reattached to container 10 and the radioactive material 24 is ready for transport with the container positioned so that it and the mounts 22 are all in substantially the same horizontal plane and the transfer passage 110 is positioned below the central axis 29 of the container 10.

While the particular container 10 as herein shown and disclosed in detail is fully capable of obtaining the objectives and providing the advantages herein before stated, it is to be understood that it is merely illustrative of the presently preferred embodiments of the invention and that no limitations are intended to the details of construction or design herein shown other than as described in the appended claims.

What is claimed is:

1. A wall used with a liquid for shielding radioactive material, the wall comprising:

a) an inner section having an interior surface for being exposed to the radioactive material;

b) an outer section;

c) a substantially tubular liquid section disposed between the inner section and the outer section, the liquid section having a central axis;

d) a divider separating the liquid section into a main reservoir and an auxiliary reservoir, the main reservoir for being substantially full of the liquid and the auxiliary reservoir for being partly filled with the liquid; and e) a transfer passage which connects the main reservoir in fluid communication with the auxiliary reservoir and allows for the transfer of liquid between the main reservoir and the auxiliary reservoir to maintain the main reservoir substantially full of the liquid, the transfer passage having a first opening which opens into the main reservoir and a second opening which opens into the auxiliary reservoir; wherein both the first opening and the second opening are positioned below the central axis of the liquid section when the liquid section is oriented for shipping.

2. The wall of claim 1 wherein the transfer passage is disposed solely in the divider.

3. The wall of claim 1 wherein the liquid section includes a liquid inlet and a liquid overflow for substantially filling the main reservoir and partially filling the auxiliary reservoir with the liquid.

4. The wall of claim 1 wherein the main reservoir and the auxiliary reservoir are substantially side-by-side and substantially axially in-line.

5. A container comprising the wall of claim 1, wherein the inner section, the outer section and the liquid section are substantially tubular shaped.

6. The container of claim 5 further comprising a first end having a cask opening for receiving the radioactive material therethrough and an enclosed second end.

7. The wall of claim 1 wherein the transfer passage is an aperture in the divider; wherein both the first opening and the second opening are positioned proximate the divider and wherein both the first opening and the second opening are positioned proximate a lower portion of the liquid section when the liquid section is oriented for shipping.

8. A container used with a liquid for storing and shipping radioactive waste, the container comprising:

a) a first end having a cask opening which is sized and shaped to receive the radioactive waste therethrough;

b) a substantially enclosed second end;

c) a tubular wall which cooperates with the first and second ends to define an inner chamber, the tubular wall having: (i) a tubular inner section; (ii) a tubular, substantially sealed, liquid section which substantially encircles the inner section, the liquid section having a central axis; and (iii) a tubular, outer section which substantially encircles the liquid section;

d) a divider in the liquid section which separates the liquid section into a main reservoir and an auxiliary reservoir; and e) a transfer passage connecting the main reservoir in fluid communication with the auxiliary reservoir and allowing for the transfer of liquid between the main reservoir and the auxiliary reservoir to maintain the main reservoir substantially full of the liquid, the transfer passage having a first opening which opens into the main reservoir and a second opening which opens into the auxiliary reservoir; wherein both the first opening and the second opening are positioned at approximately the same distance from the central axis of the liquid section; wherein both the first opening and the second opening are positioned at approximately the same azimuthal direction; wherein both the first opening and the second opening are positioned below the central axis of the liquid section when the liquid section is oriented for shipping.

9. The container of claim 8 further comprising a tubular gamma section and a tubular intermediate section disposed between the inner section and the liquid section, wherein, the gamma section substantially encircles the inner section and the intermediate section substantially encircles the gamma section.

10. The container of claim 8 wherein the transfer passage extends solely through the divider and wherein both the first opening and the second opening are positioned proximate a lower portion of the liquid section when the liquid section is oriented for shipping.

11. The container of claim 8 further comprising a pair of impact limiters for protecting the container in the event of an accident, each is impact limiter disposed proximate one of the ends of the container.

12. The container of claim 11 wherein the inner chamber is sized and shaped to receive at least four PWR Assemblies.

13. The container of claim 11 wherein the inner chamber is sized and shaped to receive at least nine BWR Assemblies.

14. The container of claim 8 wherein the transfer passage is disposed substantially solely in the divider.

15. The container of claim 8 wherein the transfer passage is an aperture in the divider.

16. A portable container for storing and transporting fuel assemblies having a square cross-section, the container comprising:

a) a first end having a cask opening which is sized and shaped to receive the fuel assemblies therethrough and a cask closure for selectively sealing the cask opening; b) an enclosed second end;

c) a tubular wall which cooperates with the first end and the second end to define a selectively sealed inner chamber having a square cross-section that is sized to receive the fuel assemblies therein, the tubular wall having: (i) a tubular, metallic inner section having an interior surface which defines a portion of the inner chamber; (ii) a tubular, gamma section which substantially encircles the inner section; (iii) a tubular, metallic intermediate section which substantially encircles the gamma section; (iv) a tubular, selectively sealed, liquid section which substantially encircles the intermediate section; and (v) a tubular, metallic outer section which substantially encircles the liquid section;

d) a divider which extends between the intermediate section and the outer section and separates the liquid section into a tubular, main reservoir and a tubular auxiliary reservoir;

e) a liquid including water which substantially fills the main reservoir and partly fills the auxiliary reservoir; and f) a transfer passage defined by an aperture positioned in the divider, the aperture connecting the main reservoir in fluid communication with the auxiliary reservoir and allows for the transfer of liquid between the main reservoir and the auxiliary reservoir to maintain the main reservoir full of liquid, the aperture having a first opening which opens into the main reservoir and a second opening which opens into the auxiliary reservoir; wherein both the first opening and the second opening are positioned proximate a lower portion of the liquid section when the liquid section is oriented for shipping; wherein both the first opening and the second opening are positioned below a central axis of the liquid section when the liquid section is oriented for shipping.

17. The container of claim 16 further comprising a pair of impact limiters for protecting the container in the event of an accident, each impact limiter disposed proximate one of the ends of the container.

18. The container of claim 17 further comprising a stiffening ring which extends between the intermediate section and the outer section in the liquid section for stiffening the container.

19. The container of claim 16 wherein the inner chamber is sized and shaped to receive at least four PWR Assemblies.

20. The container of claim 16 wherein the inner chamber is sized and shaped to receive at least four PWR Assemblies.

* * * * *